US009104173B2

(12) United States Patent
Murayama

(10) Patent No.: US 9,104,173 B2
(45) Date of Patent: Aug. 11, 2015

(54) IMAGE FORMING APPARATUS

(71) Applicant: Brother Kogyo Kabushiki Kaisha, Nagoya-shi, Aichi-ken (JP)

(72) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1 day.

(21) Appl. No.: 14/040,793

(22) Filed: Sep. 30, 2013

(65) Prior Publication Data

US 2014/0147153 A1 May 29, 2014

(30) Foreign Application Priority Data

Nov. 28, 2012 (JP) ..... 2012-259988

(51) Int. Cl.
*G03G 15/00* (2006.01)
*G03G 21/16* (2006.01)

(52) U.S. Cl.
CPC ..... *G03G 21/1661* (2013.01); *G03G 15/5054* (2013.01)

(58) Field of Classification Search
USPC ..... 399/74; 362/249.01, 362, 382; 361/600; 248/220.22; 250/239
See application file for complete search history.

(56) References Cited

U.S. PATENT DOCUMENTS

2004/0251435 A1* 12/2004 Sawayama et al. ..... 250/559.16
2014/0084145 A1* 3/2014 Guan et al. ..... 250/216

FOREIGN PATENT DOCUMENTS

JP 2005-037585 A 2/2005

* cited by examiner

*Primary Examiner* — David Gray
*Assistant Examiner* — Michael Harrison
(74) *Attorney, Agent, or Firm* — Banner & Witcoff, Ltd.

(57) ABSTRACT

An image forming apparatus, comprising: an image formation unit configured to form an image on a sheet; a sensor unit having a light-emitting device and a light-receiving device; a frame to which the sensor unit is attached; at least one projection provided on one of the sensor unit and the frame, the at least one projection being formed to have a contacting part which projects to contact an other of the sensor unit and the frame; and at least one engagement part provided on one of the sensor unit and the frame, the at least one engagement part being formed to engage with at least one catching part provided on an other of the sensor unit and the frame and to press the at least one projection in a direction of increasing a contact surface pressure of the contacting part by causing elastic deformation.

8 Claims, 7 Drawing Sheets

IMAGE FORMING APPARATUS

CROSS-REFERENCE TO RELATED APPLICATION

This application claims priority under 35 U.S.C. §119 from Japanese Patent Application No. 2012-259988, filed on Nov. 28, 2012. The entire subject matter of the application is incorporated herein by reference.

BACKGROUND

1. Technical Field

Aspects of the present invention relate to an image forming apparatus configured to form an image on a sheet.

2. Related Art

In general, in an image forming apparatus, a sensor unit having a light-emitting device and a light-receiving device is fixed to a main body with screws.

SUMMARY

However, if an image forming apparatus has a configuration where a sensor unit is fixe with screws, a process for screwing the sensor unit to a main body is required. Therefore, it is difficult to decrease the assembling man-hour.

Aspects of the present invention are advantageous in that they provide an improved attaching configuration of a sensor unit having a light-emitting device and a light-receiving device.

According to an aspect of the invention, there is provided an image forming apparatus, comprising: an image formation unit configured to form an image on a sheet; a sensor unit having a light-emitting device and a light-receiving device; a frame to which the sensor unit is attached; at least one projection provided on one of the sensor unit and the frame, the at least one projection being formed to have a contacting part which projects to contact an other of the sensor unit and the frame; and at least one engagement part provided on one of the sensor unit and the frame, the at least one engagement part being formed to engage with at least one catching part provided on an other of the sensor unit and the frame and to press the at least one projection in a direction of increasing a contact surface pressure of the contacting part by causing elastic deformation.

BRIEF DESCRIPTION OF THE ACCOMPANYING DRAWINGS

DETAILED DESCRIPTION

Figure 1:
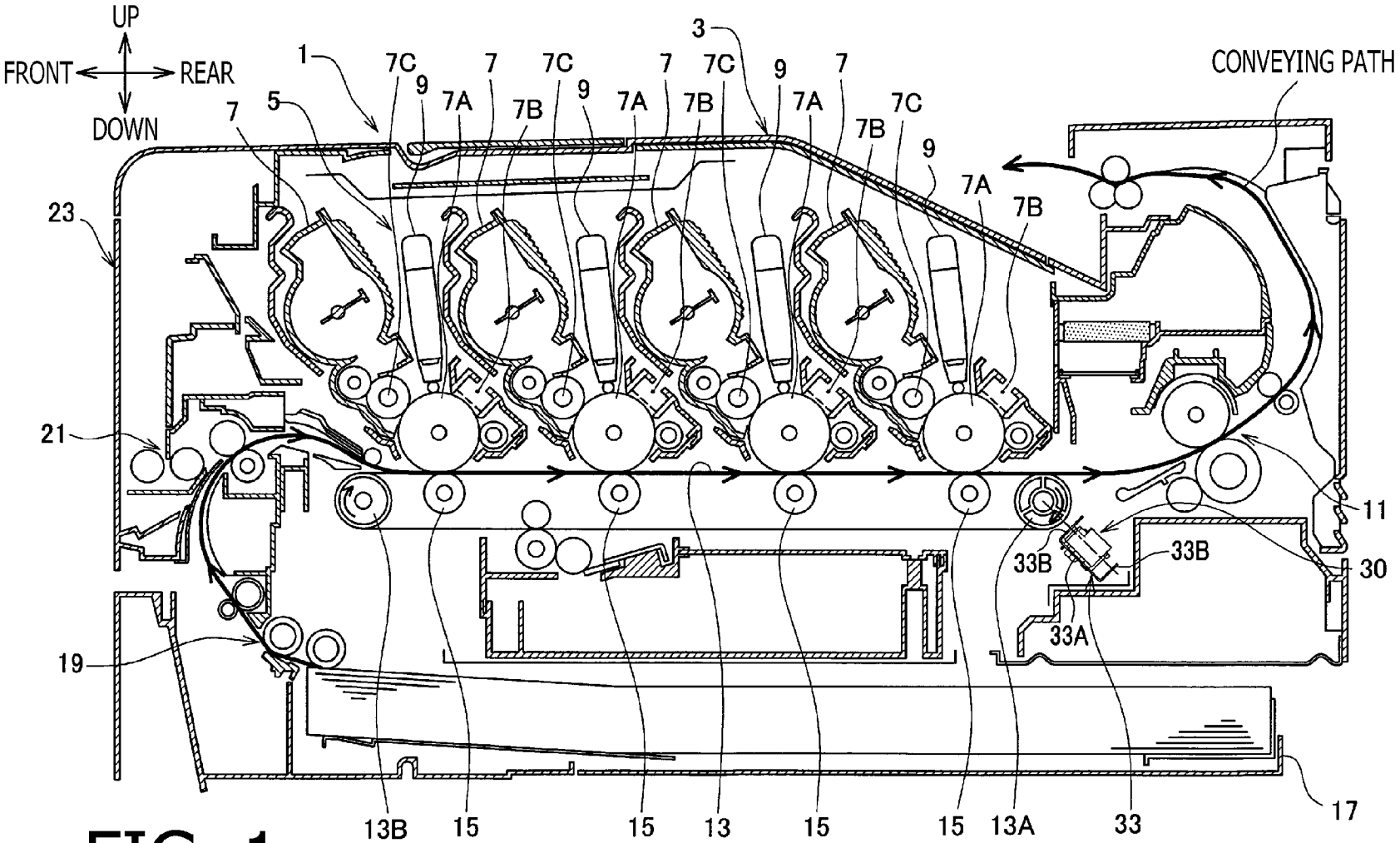
FIG. 1 illustrates a central cross section of an image forming apparatus according to an embodiment.

In the following, embodiments are described by way of example. It should be noted that elements described in the attached claims are not limited to concrete units and configurations descried in the following embodiments.

In the embodiments, the invention is applied to an image forming apparatus of an electrophotographic type. Hereafter, embodiments according to the invention will be described with reference to the accompanying drawings. It should also be noted that arrows affixed to the drawings for showing directions are provided for understanding of the relationship between the drawings, and the invention is not limited to the directions shown in the drawings.

First Embodiment

1. General Description of Image Forming Apparatus

As shown in FIG. 1, in a housing 3 of an image forming apparatus 1, an image formation unit 5 configured to form an image on a sheet, such as a recording sheet of paper, is accommodated. The image formation unit 5 according to the embodiment is an electrophotographic type. That is, the image formation unit 5 has a process cartridge 7, an exposure unit 9 and a fixing unit 11.

The image formation unit 5 according to the embodiment is configured as a color type. Therefore, the image formation unit 5 has a plurality of process cartridges 7. Each process cartridge 7 is disposed along a direction perpendicular to an axial direction of a photosensitive drum 7A. The process cartridges 7 respectively correspond to yellow, magenta, cyan and black.

Each process cartridge 7 is detachably attachable to a main body. The process cartridges 7 have substantially the same configuration, excepting that the process cartridges 7 differ from each other in regard to colors of stored developers. Specifically, each process cartridge 7 has the photosensitive drum 7A, a charger 7B and a development unit 7C.

The term "main body" as used herein means a part, such as the housing 3 or a main frame (not shown), which is not detached or replaced by a user. The main frame is a pair of plate-like members provided to be away from each other in the width direction which is parallel with the axial direction of the photo sensitive drum 7A. The components, such as the process cartridge 7, constituting the image formation unit 5 are attached to the pair of main frames in a state where the components are arranged between the pair of main frames.

The photosensitive drum 7A holds a developer image to be transferred to the sheet. The charger 7B charges the photosensitive drum 7A. The exposure unit 9 forms an electrostatic latent image on the charged photosensitive drum 7A. The development unit 7C supplies the developer to the photosensitive drum 7A to form a developer image. Each photosensitive drum 7A is disposed such that the axial direction thereof is perpendicular to a sheet conveying direction.

A belt 13 is an endless belt for conveying the sheet. At a position opposite to the photosensitive drum 7A with respect to the belt 13, a transfer unit 15 is disposed. The transfer unit 15 transfers the developer held on the photosensitive drum 7A to the sheet being conveyed on the belt 13. After the developer image held on each photosensitive drum 7A is transferred to the sheet in an overlaying manner, the developer image is heated and is fixed to sheet by the fixing unit 11.

The belt 13 is provided to extend between at least two rollers 13A and 13B. The roller 13A is a drive roller which rotates the belt 13. The roller 13B is a driven roller which rotates in accordance with rotation of the drive roller 13A. A rotation center axis of each of the rollers 13A and 13B is parallel with the axial direction of the photosensitive drum 17A.

On the upstream side of the belt 13 in the sheet conveying direction, a first feeder mechanism 19 and a second feeder mechanism 21 are provided. The first feeder mechanism 19 sends out the sheet placed on a paper supply tray 17 one by one toward an image formation unit 5 side. On the paper supply tray 17, sheets to be conveyed to the image formation unit 5 are placed.

The second feeder mechanism 21 sends out the sheet placed on a multi-purpose tray (not shown) one by one toward the image formation unit 5 side. The multi-purpose tray is provided on a cover 23 disposed on the front side in the housing 3 with respect to the image formation unit 5. When the cover 23 is swung to the front side and opened, the multi-purpose tray becomes available.

Figure 2A:
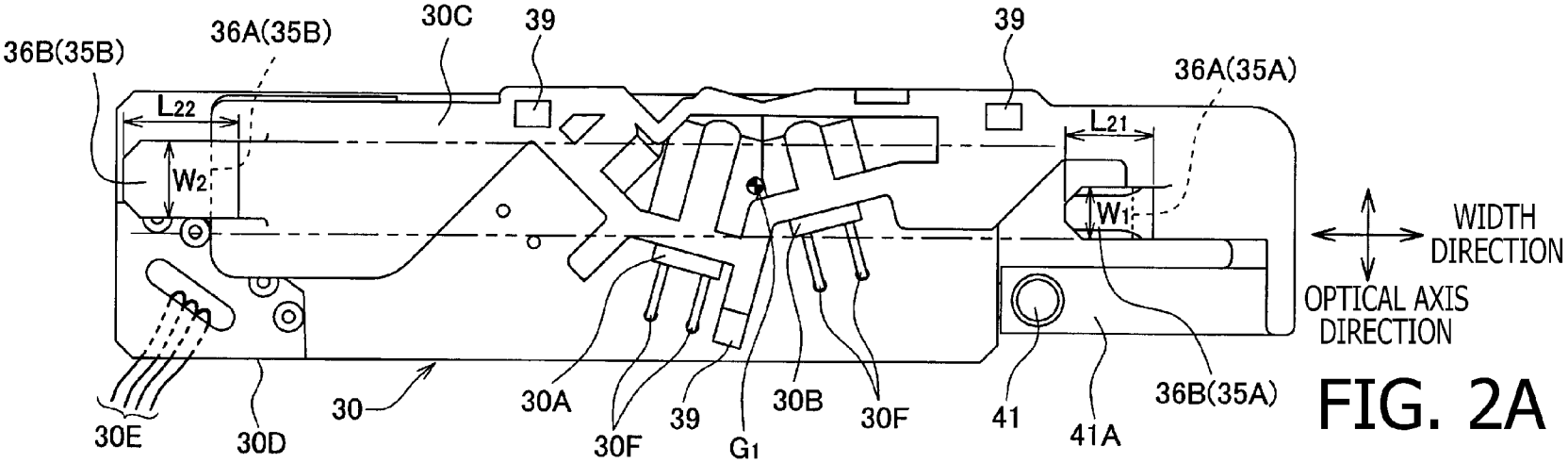
FIG. 2A is a front view of a sensor unit viewed from a holder side.

At a position facing one of the rollers 13A and 13B, a sensor unit 30 is disposed. As shown in FIG. 2A, the sensor unit 30 is integrally provided with a light-emitting device 30A and a light-receiving device 30B.

The light-emitting device 30A emits light toward a correction mark (not shown) formed on the belt 13. The light-receiving device 30B receives light reflected from the correction mark. The correction mark is a developer image transferred to the belt 13 to determine a correction amount used for correcting the shift and density of a developer image transferred to the sheet in an overlaying manner. That is, a control unit (not shown) for controlling the image formation unit 5 executes the correction as needed by controlling the various components, such as the exposure unit 9, using a signal outputted from the sensor unit 30.

The sensor unit 30 according to the embodiment is disposed at the position facing the roller 13A, i.e., the drive roller. The light-emitting device 30A and the light-receiving device 30B are aligned along the direction parallel with the rotation center axis of the roller 13A, i.e., the width direction, in a state where the devices 30A and 30B are held on a holder 30C made of resin.

The sensor unit 30 according to the embodiment is also integrally provided with a circuit board 30D for the light-emitting device 30A and the light-receiving device 30B. On the circuit board 30D, an electric wiring 30E for electrically connecting the sensor unit 30 to the control unit is provided.

Figures 3A, 3B:
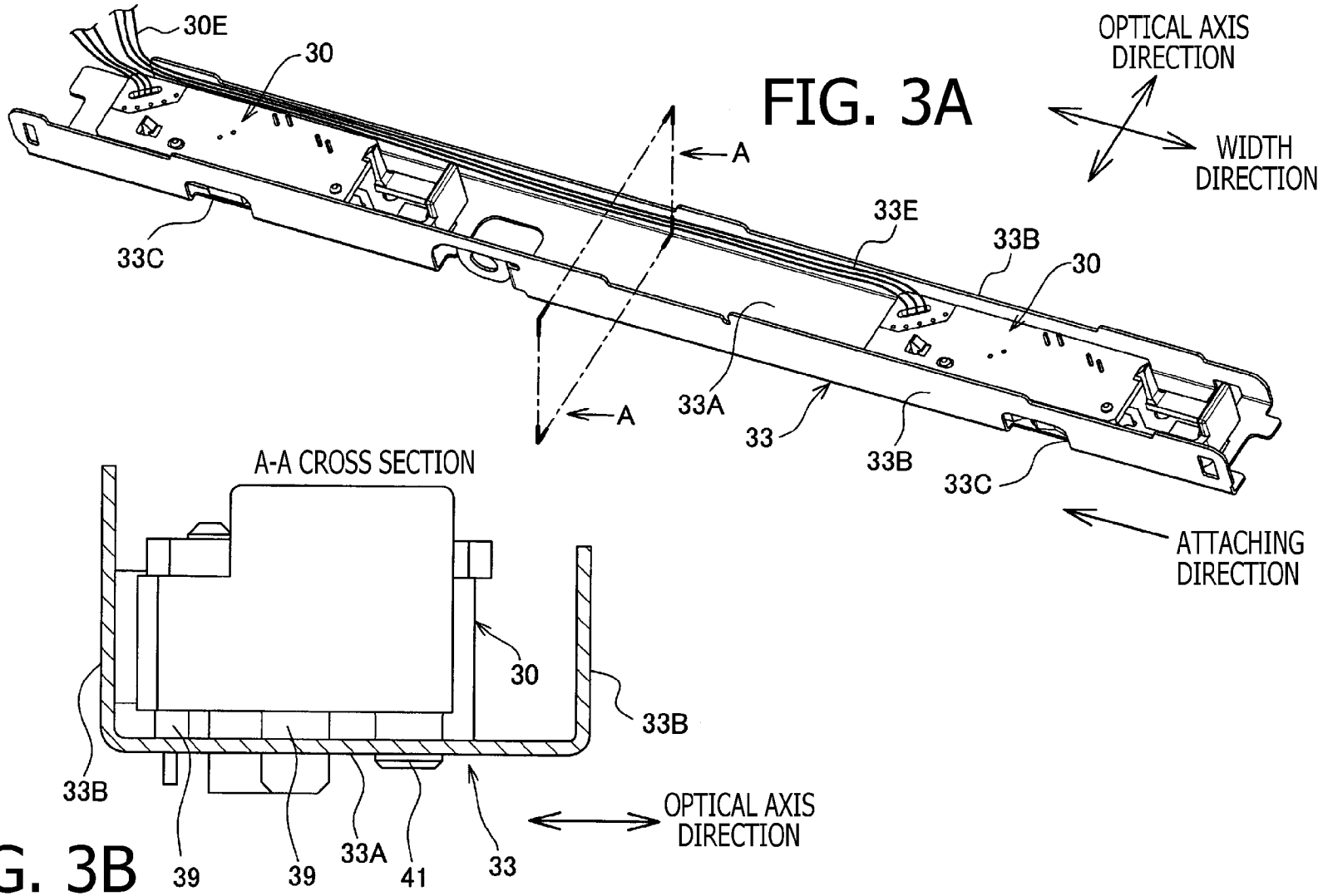
FIG. 3A is a perspective view of an attachment frame to which the sensor unit is attached.
FIG. 3B illustrates a A-A cross section in FIG. 3A.

As shown in FIG. 3A, at least the electric wiring 30E provided for the right side sensor unit 30 on the paper face of FIG. 3A is laid to extend in parallel with an extending direction of a second extending part 36B (described later), i.e., an attaching direction.

Figure 2B:
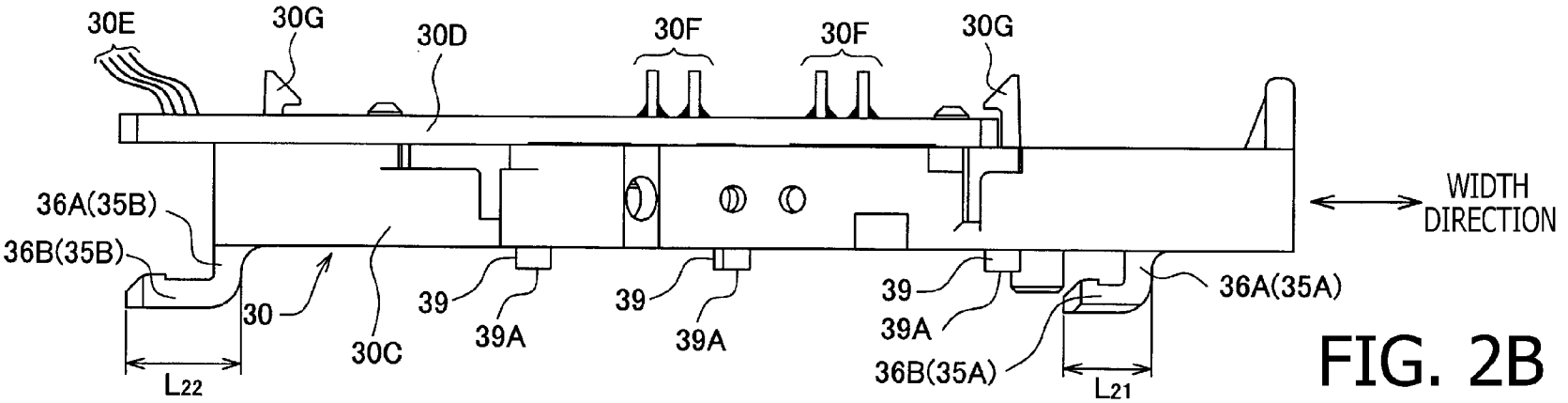
FIG. 2B is a top view of the sensor unit.

Each of the light-emitting device 30A and the light-receiving device 30B is held by being fitted into a hole (not shown) formed in the holder 30C. As shown in FIG. 2B, terminals 30F of the light-emitting device 30A and the light-receiving device 30B are mounted on the circuit board 30D by through-hole technology. Therefore, the circuit board 30D is fixed to the holder 30C via the light-emitting device 30A and the light-receiving device 30B.

2. Attaching Structure of Sensor Unit

(2.1 General Description of Attaching Structure)

The sensor unit 30 is attached to an attachment frame 33 shown in FIG. 3A. The attachment frame 33 is a beam-like member extending in the width direction. Both ends of the attachment frame 33 in the longer side direction are attached directly or indirectly to the pair of main frames in a state where the attachment frame 33 is disposed between the pair of main frames.

In this embodiment, a plurality of sensor units 30 is provided, and the sensor units 30 are provided on both end sides in the longer side direction of the attachment frame 33. As shown in FIG. 3B, the attachment frame 33 has a nearly U-shaped or C-shaped cross section having an opened part in a direction perpendicular to the longer side direction.

That is, the cross-sectional shape of the attachment frame 33 is constituted by a bottom wall part 33A and a pair of side wall parts 33B. The bottom wall part 33A is a zonal portion facing the sensor unit 30. The pair of side wall parts 33B is zonal portions which are provided at both ends of the bottom wall part 33A in the width direction to face with each other. The attachment frame 33 is integrally formed with the bottom wall part 33A and the pair of side wall parts 33B, and is formed by subjecting a metal plate, such as SPCC, to press processing.

Of the pair of side wall parts 33B, the side wall 33B facing the roller 13A has a window 33C through which light passes as shown in FIG. 3A. Therefore, the pair of side walls 33B according to the embodiment are disposed to face with each other in the optical axis direction with respect to the sensor unit 30.

The light-emitting device 30A and the light-receiving device 30B are disposed in the main body as described below. That is, the light-emitting device 30A and the light-receiving device 30B are disposed such that the rotational center axis of the roller 13A is included in a virtual plane including a light ray emitted from the light-emitting device 30A and a light ray incident on the light-receiving device 30B after reflected from the belt 13.

The light-emitting device 30A and the light-receiving device 30B are mounted such that an optical path length from the light-emitting device 30A to the light-receiving device 30B becomes a predetermined length. The optical axis direction means a direction which is parallel with the virtual plane and is perpendicular to the rotational center axis of the roller 13A.

(2.2 Details of Attaching Structure)

The attaching structures for attaching the sensor units 30 to the attachment frame 33 are the same. Therefore, in the following, the detail explanation about the mounting structure is given for the sensor unit 30 mounted to the right side in FIG. 3A.

Figure 4A:
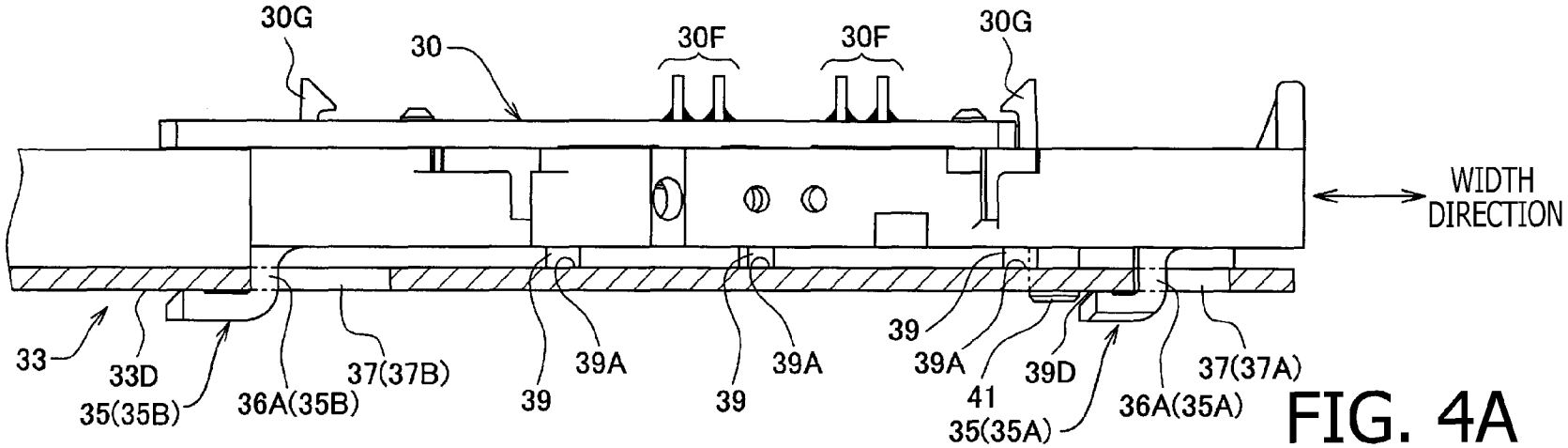
FIG. 4A illustrates a state where the sensor unit is attached to the attachment frame.

As shown in FIG. 4A, the sensor unit 30 is fixed to the attachment frame 33 due to a fact that elastically deformable engagement parts 35 are respectively engaged with catching parts 37 formed in the attachment frame 33.

At least two engagement parts 35 and at least two catching parts 37 are provided in the longer side direction of the attachment frame 33. That is, the engagement parts 35 are provided at both end portions in an extending direction of the holder 30C extending in the longer side direction of the attachment frame 33. The pair of catching parts 37 are provided at the positions corresponding to the pair of engagement parts 35.

Figure 4B:
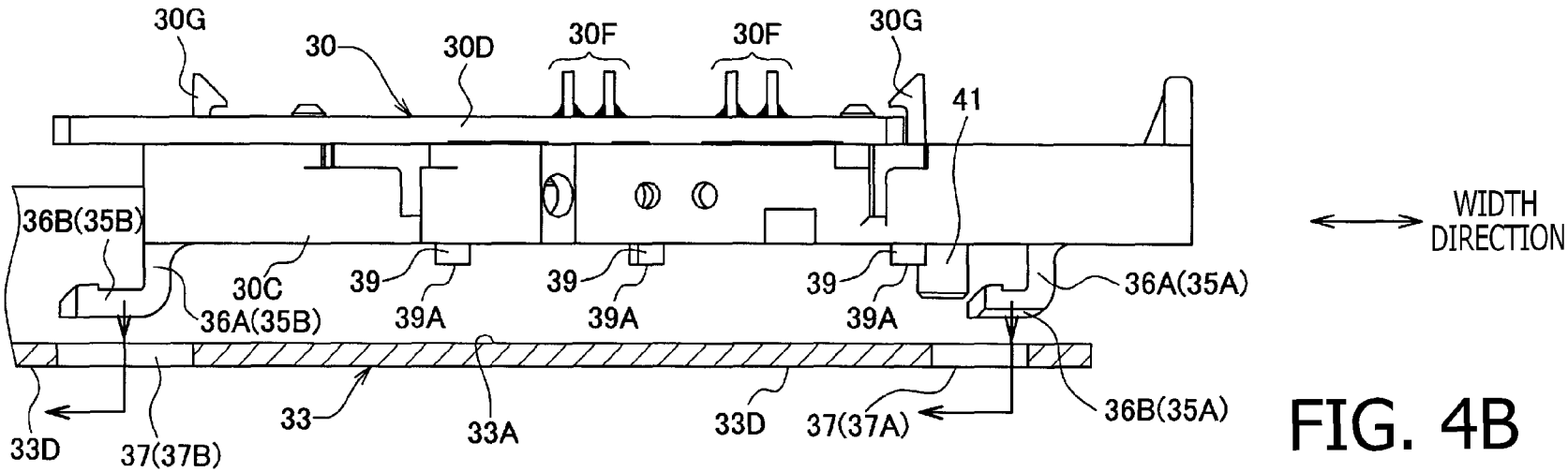
FIG. 4B illustrates a state before the sensor unit is attached to the attachment frame.

Of the pair of engagement parts 35, the engagement part 35 on the right side on the paper surface of FIGS. 4A and 4B is referred to as a first engagement part 35A, and the engagement part 35 provided on the left side on the paper face of FIGS. 4A and 4B is referred to as a second engagement part 35B. The right side catching part 37 on the paper face of FIGS. 4A and 4B is referred to as a first catching part 37A, and the left side catching part 37 on the paper face of FIG. 4B is referred to as a second catching part 37B. When the first and second engagement parts 35A and 35B are collectively referred to, they are called the engagement part 35. On the other hand, when the first and second catching parts 37A and 37B are collectively referred to, they are called the catching part 37.

As shown in FIG. 4B, the engagement part 35 is formed to have a shape of a letter "L". That is, the engagement part 35 is generally formed to have two parts, i.e., a first extending part 36A and a second extending part 36B, so that the engagement part 35 is formed to have a shape of a letter L. The first extending part 36A is a projected part extending in a direction parallel with a projecting direction of a first projection 39, i.e., extending from the sensor unit 30 to the bottom wall 33A side.

The second extending part 36B is a part extending from the tip of the first extending part 36A in a direction perpendicular to the extending direction of the first extending part 36A. In this embodiment, the second extending part 36B of the first engagement part 35A and the second extending part 36B of the second engagement part 35B extend in the same direction.

The extending direction of the second extending part 36B is parallel with the rotational axis of the roller 13A, i.e., the longer side direction of the attachment frame 33. In the following, the extending direction of the second extending part 36B, i.e., the direction pointing from the first engagement part 35A to the second engagement part 35B (the leftward direction in FIG. 4B) is referred to as "attaching direction".

The first catching part 37A is a through hole through which the first extending part 36A of the first engagement part 35A penetrates. Similarly, the second catching part 37B is a through hole through which the first extending part 36A of the second engagement part 35B penetrates. The first and second catching parts 37A and 37B are formed in the bottom wall part 33A.

In the following, the first catching part 37A is also referred to as a first through hole 37A. Similarly, the second catching part 37B is also referred to as a second through hole 37B. When the first and second through holes 37A and 37B are collectively referred to, the first and second through holes 37A and 37B are called the through hole 37.

Figure 5A:
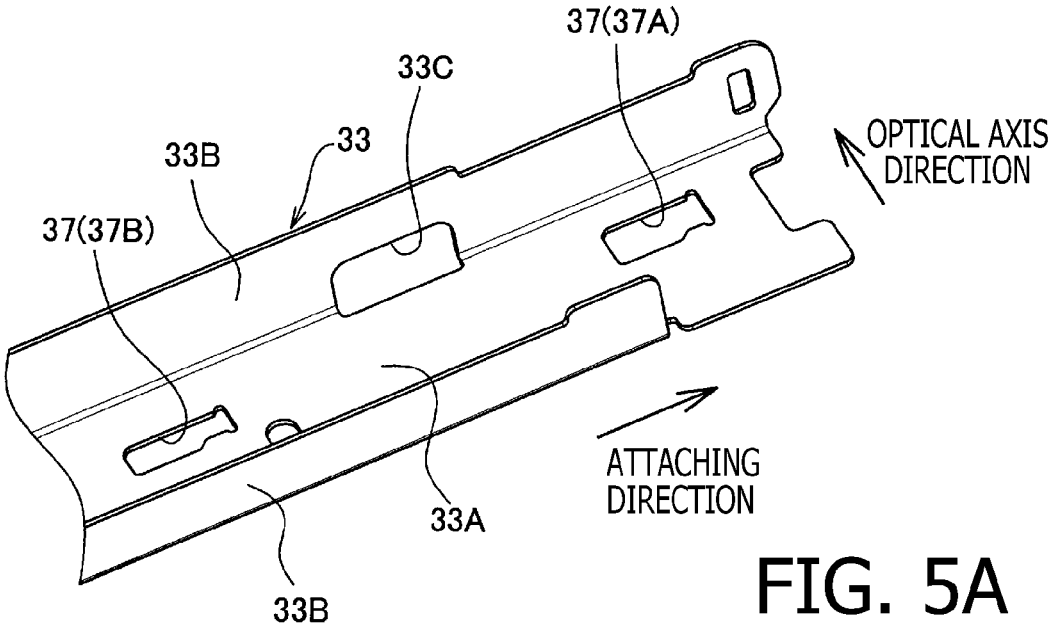
FIG. 5A is a perspective view of the attachment frame.

As shown in FIG. 5A, the first and second through holes 37A and 37B have the similar hole shape. That is, the size L1 of the longer side of each of the first and second through holes 37A and 37B is larger than the lengths L21 and L22 of the second extending parts 36B in the extending direction shown in FIG. 2B.

Therefore, in this embodiment, a worker is able to insert the pair of engagement parts 35 into the though holes 37, respectively, along the direction perpendicular to the bottom wall part 33A. When the second extending part 36B reaches a position opposite to the sensor unit 30 with respect to the bottom wall part 33A and the worker further moves the sensor unit 30 to the tip side in the extending direction of the second extending part 36B, i.e., the attaching direction, each second extending part 36B is held by contacting a peripheral portion of the through hole 37 as shown in FIG. 4A.

At least one first projection 39 is provided on the holder 30C, i.e., a part of the sensor unit 30C facing the bottom wall part 33A. The first projection 39 protrudes from the above described part of the sensor unit 30 toward the bottom wall part 33A, and has a contacting part 39A (which contacts the bottom wall part 33A) at the tip of the first projection 39 in the projecting direction.

When the second extending part 36B is engaged with the portion around the through hole 37 while contacting a surface 33D (hereafter, referred to as an engagement surface 33D) of the bottom wall part 33A opposite to the sensor unit 30, the contacting part 39A is pressed in the direction of increasing the contact surface pressure with respect to the bottom wall part 33A by the engagement part 35.

Figure 5B:
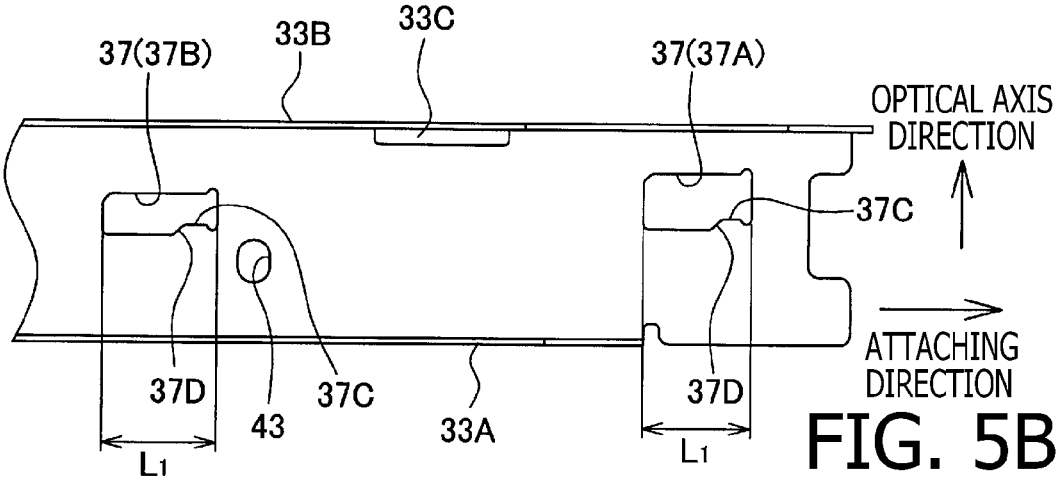
FIG. 5B is a top view of the attachment frame.
Figure 5C:
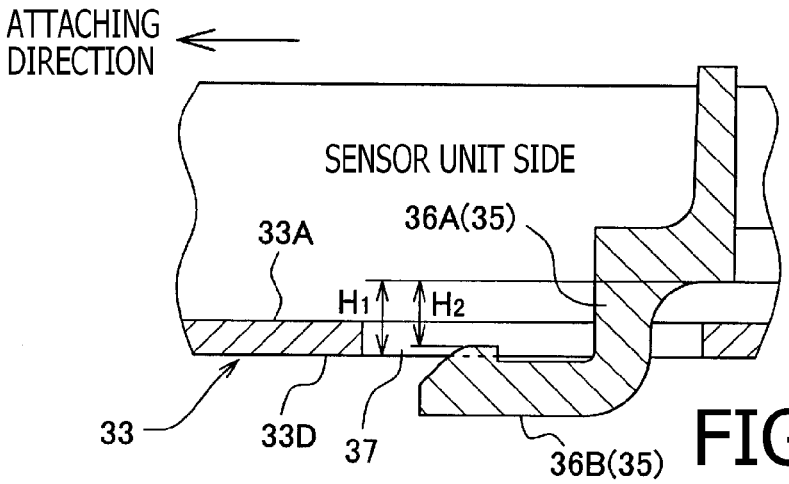
FIG. 5C is an enlarged view of an engagement part.

That is, as shown in FIG. 5C, in a state where the contacting part 39A contacts the bottoms wall part 33A and the second extending part 36B is not engaged with the portion around the through hole 37, the second extending part 36B is situated on the sensor unit 30 side with respect to the engagement surface 33D.

Specifically, before the second extending part 36B contacts the engagement surface 33D, the distance H2 from a root of the first extending part 36A to the second extending part 36B is smaller than the distance H1 from the root of the first extending part 36A to the engagement surface 33D.

Therefore, when the second extending part 36B contacts the engagement surface 33D and is engaged with the portion around the through hole 37, the engagement part 35 becomes a deformed state. Therefore, in this case, the contacting part 39A is pressed against the engagement surface 33D.

As shown in FIG. 2A, in this embodiment, three first projections 39 are provided between the first engagement part 35A and the second engagement part 35B. The three first projections 39 are disposed as described below.

The three first projections 39 are disposed such that the face center G1 of a plane figure defined by the three first projections 39 as apexes lies within a zonal virtual area (an area surrounded by a double-chain line) connecting the two engagement parts 35. The term "the face center of the plane figure" means a point at which the moment of area balances.

As shown in FIG. 2A, the virtual area (the area surrounded by the double-chain line) is a zonal area which extends in parallel with the extending direction of the second extending part 36B and in which the pair of engagement parts 35 are included.

As shown in FIG. 5A, the through hole 37 is a substantially rectangular hole. The longer side direction of the through hole 37 is in parallel with the attaching direction. The shorter side direction of the though hole 37, i.e., the direction perpendicular to the attaching direction is in parallel with the optical axis direction.

At a part on an outer edge of the through hole 37 parallel with the attaching direction, a pressing part 37C protruding to the optical axis direction (on the window 33C side in this embodiment) is provided. The pressing part 37C contacts and presses the first extending part 36A toward the optical axis direction when the second extending part 36B is engaged with the portion around the through hole 37.

Therefore, when the second extending part 36B is engaged with the portion around the through hole 37, the first extending part 36A contacts the outer edge of the through hole 37, so that movement of the engagement part 35 in the direction (i.e., the optical axis direction) perpendicular to the extending direction of the first extending part 36A and the extending direction of the second extending part 36B is restricted, and the engagement part 35 is positioned.

At an end part 37D positioned on an opposite side in the attaching direction of an outer edge of the pressing part 37C, a curved surface part connecting smoothly the pressing part 37C with a neighboring outer edge part of the through hole 37 or a slanting part slanting with respect to the attaching direction is provided. Therefore, when the engagement part 35 moves in the attaching direction, the first extending part 36A is prevented from being damaged, for example, by preventing the end part 37D from cutting into the first extending part 36A.

As shown in FIG. 4B, at a portion of the holder 30C, i.e., the sensor unit 30, facing the bottom wall part 33A, at least one second projection 41 is provided. The second projection 41 protrudes at the portion toward the bottom wall part 33A and fits into a recessed part 43 shown in FIG. 5B.

Since the second projection 41 contacts the inner circumferential surface of the recessed part 43, movement of the second projection 41 in the direction parallel with the attaching direction is restricted. As a result, the sensor unit 30 is positioned in regard to the direction parallel with the attaching direction by the second projection 41.

Figure 6:
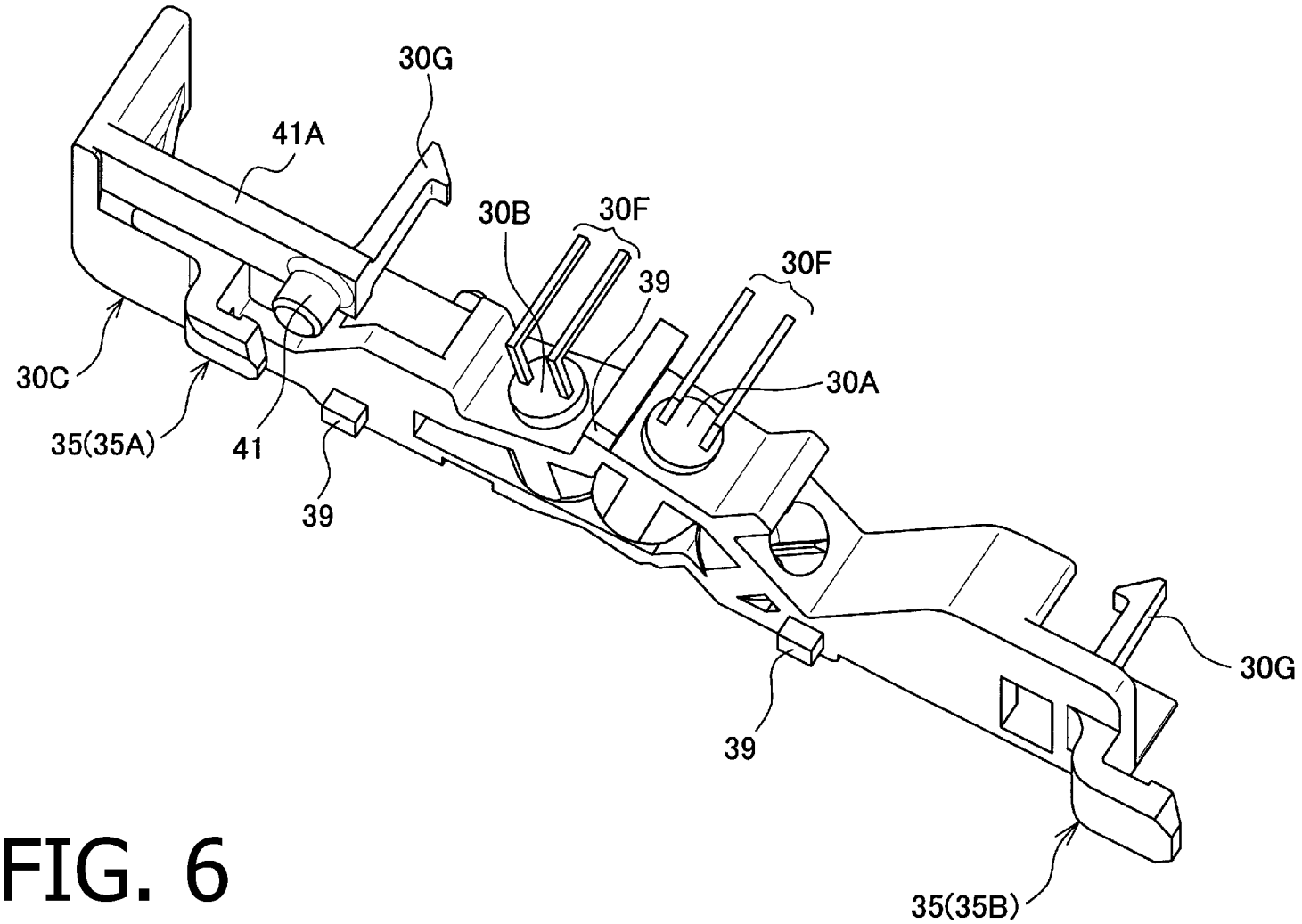
FIG. 6 is a perspective view of a holder according to the embodiment.

In this embodiment, the recessed part 43 is formed as an elliptical through hole formed in the bottom wall part 33A of the attachment frame 33. The shorter side direction of the elliptical through hole is parallel with the attaching direction. On the other hand, as shown in FIG. 6, the second projection 41 is formed to have a shape of a cylinder having the diameter equal to the size in the minor axis direction of the recessed part 43.

Therefore, when the second projection 41 fits into the recessed part 43, the second projection 41 contacts a portion on the inner circumferential surface of the recessed part 43 parallel with the longer side direction. As a result, movement of the second projection 41 in the minor axis direction, i.e., the direction parallel with the attaching direction, is restricted.

Furthermore, the second projection 41 is movable in the direction substantially perpendicular to the bottom wall part 33A. Specifically, the second projection 41 is provided at the tip of an arm part 41A of an elastically deformable cantilever type. Therefore, when the sensor unit 30 is moved in parallel with the attaching direction, the second projection 41 can be moved to the holder 39C side. As a result, the worker is able to easily engage the engagement part 35 with the catching part 37.

In this embodiment, a pair of snap fits 30G for tentatively fixing the circuit board 30D to the holder 30C before the terminals 30F are soldered to the circuit board 30D are provided. In particular, the snap fit 30G provided on the second projection 41 side is located at the tip of the arm part 41A on the opposite side with respect to the second projection 41. In this embodiment, the first projection 39, the arm part 41A, the second projection 41 and the engagement part 35 are integrally formed with the holder 30C with resin material.

As shown in FIG. 2A, the second projection 41 is provided on the first engagement part 35A side with respect to the central portion between the first engagement part 35A and the second engagement part 35B. The length L22 of the second extending part 36B in the extending direction provided on the second engagement part 35B is longer than the length L21 of the second extending part 36B in the extending direction provided on the first engagement part 35A.

Therefore, in this embodiment, the geometrical moment of inertia of the second extending part 36B of the second engagement part 35B is larger than the geometrical moment of inertia of the second extending part 36B of the first engagement part 35A.

Specifically, the size W2 in the optical axis direction of the second extending part 36B provided on the second engagement part 35B is larger than the size W1 in the optical axis direction of the second extending part 36B provided on the first engagement part 35A.

3. Feature of Image Forming Apparatus of Embodiment

As described above, in this embodiment, the contacting part 39A of the first projection 39 contacts the attachment frame 33 in a state where the first projection 39 is pressed against the attachment frame 33. Therefore, the sensor unit 30 is attached to the attachment frame 33 in the state where the sensor unit 30 is positioned with respect to the attachment frame 33.

That is, according to the embodiment, the sensor unit 30 can be positioned and attached to the attachment frame 33 without using screws. In addition, fixing by engagement requires less man-hour relative to fixing by screws. Therefore, according to the embodiment, it is possible to attach the sensor unit 30 to the attachment frame 33 with a high degree of precision while decreasing man-hour for attachment.

In this embodiment, the position of the sensor unit 30 in the optical axis direction is restricted by the first extending part 36A. The position of the sensor unit 30 in the direction parallel with the extending direction of the second extending part 36B is restricted by the second projection 41. Furthermore, the position of the sensor unit 30 in the optical axis direction and the direction perpendicular to the extending direction of the second extending part 36B is restricted by the first projection 39.

Therefore, the worker is able to easily attach the sensor unit 30 to the attachment frame 33 while positioning the sensor unit 30 in regard to the above described three directions which are perpendicular to each other, by translating the sensor unit 30 in the extending direction of the second extending part 36B, i.e., in the attaching direction.

In this embodiment, the second extending part 36B extends in the direction pointing from the first engagement part 35A side to the second engagement part 35B side. The second projection 41 is provided on the first engagement part 35A side with respect to the center between the first engagement part 35A and the second engagement part 35B. The length L22 of the second extending part 36B in the extending direction provided on the second engagement part 35B is larger than the length L21 in the extending direction of the second extending part 36B provided on the first engagement part 35A.

Figure 7:
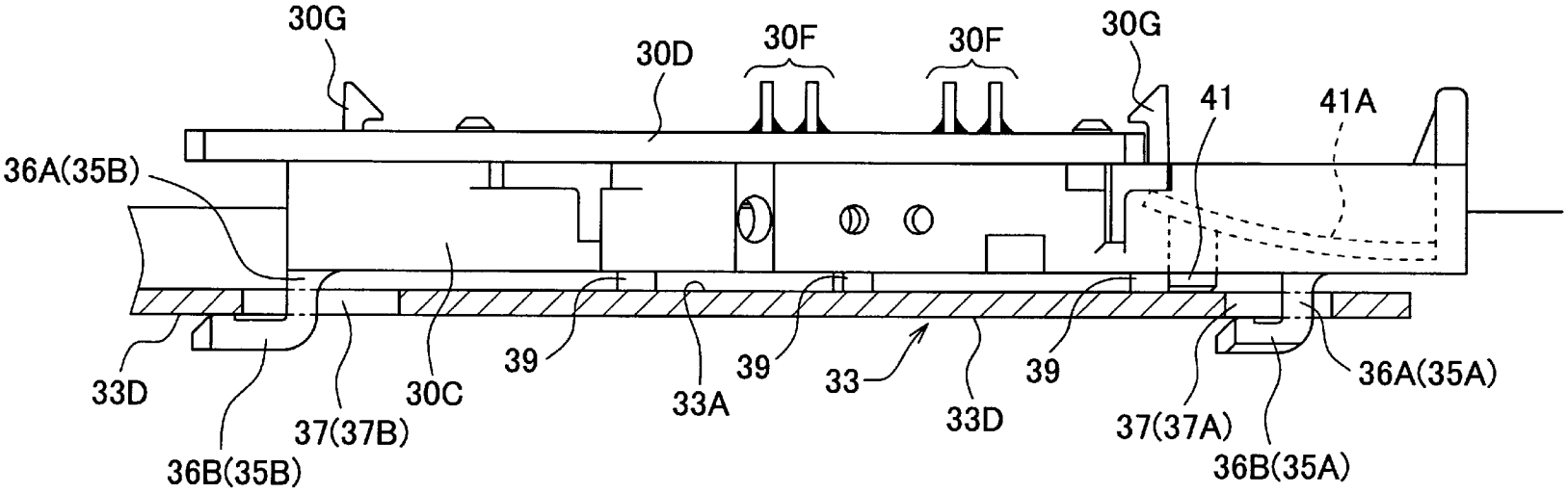
FIG. 7 is an explanatory illustration for explaining features of the embodiment.

With this configuration, in this embodiment, the worker is able to engage the second engagement part 35B to the second catching part 37B before the second projection 41 is fitted into the recessed part 43 as shown in FIG. 7. As a result, the worker is able to fit the second projection 41 into the recessed part 43 by handling the sensor unit 30 as a lever such that the second engagement part 35B side serves as the point of support of the lever, the first engagement part 35A side serves as the power point of the lever, and the second projection 41 serves as the point of action of the lever. Therefore, the worker is able to easily attach the sensor unit 30 to the attachment frame 33.

As shown in FIG. 7, the second projection 41 moves in the direction of departing from the bottom wall part 33A before the second projection 41 fits into the recessed part 43 during the above described attachment work. Therefore, the worker is able to easily attach the sensor unit 30 to the attachment frame 33 thanks to the effect of the above described "lever".

Furthermore, in this embodiment, the geometrical moment of inertia of the second extending part 36B provided on the second engagement part 35B is larger than the geometrical moment of inertia of the second extending part 36B provided on the first engagement part 35A.

As a result, in this embodiment, it is possible to prevent the second extending part 36B of the second engagement part 35B from being deformed excessively even when the length L22 in the extending direction of the second extending part 36B provided on the second engagement part 35B is larger than the length L21 in the extending direction of the second extending part 36B provided on the first engagement part 35A.

Furthermore, as shown in FIG. 3A, the electric wiring 30E provided for the sensor unit 30 is extended in the direction parallel with the extending direction of the second extending part 36B, i.e., the electric wiring 30E is extended from the right side to the left side on the paper face of FIG. 3A.

With this configuration, if the electric wiring 30E is pulled in the extending direction of the electric wiring 30E, i.e., in the attaching direction, the first extending part 36A contacts the outer edge of the through hole, i.e., the catching part 37.

Therefore, the sensor unit 30 never moves together with the electric wiring 30E. Consequently, even when the electric wiring 30E is pulled strongly by the worker in the extending direction of the electric wiring 30E, the sensor unit 30 is never detached from the attachment frame 33.

In this embodiment, at least three first projections 39 are provided, and the face center G1 of a plane figure dined by the plurality of first projections 39 as apexes lies within the zonal virtual area connecting the two engagement parts 35. As a result in this embodiment, the sensor unit 30 can be positioned in a stable state.

OTHER EMBODIMENTS

In the above described embodiment, the first projection 39, the second projection 41 and the engagement part 35 are provided on the sensor unit 30, and the catching part 37 and the recessed part 43 are provided on the attachment frame 33; however, the present invention is not limited to such a configuration. For example, the first projection 39, the second projection 41 and the engagement part 35 may be provided on the attachment frame 33, and the catching part 37 and the recessed part 43 may be provided on the sensor unit 30.

In the above described embodiment, two engagement parts 35 are provided; however, the present invention is not limited to such a configuration. One engagement part 35 or more than two engagement parts 35 may be provided.

In the above described embodiment, the catching part 37 is formed as a through hole formed to penetrate through the attachment frame 33; however, the present invention is not limited to such a configuration. For example, the catching part 37 may be formed as an L-shaped hole having vertical and horizontal holes.

In the above described embodiment, the engagement part 35 causes almost no elastic deformation when the engagement part 35 is inserted into the through hole catching part 37, i.e., the through hole 37, but the engagement par 35 causes elastic deformation when the engagement part 35 is moved in the attaching direction and thereby the second extending part 36B contacts the engagement surface 33D. However, the present invention is not limited to such a configuration. For example, the engagement part 35 may be inserted into the catching part 37 while being elastically deformed, as in the case of a snap fit.

In the above described embodiment, the second projection 41 is provided on the first engagement part 35A side with respect to the center between the first engagement part 35A and the second engagement part 35B; however, the present invention is not limited to such a configuration. For example, the second projection 41 may be provided on the second engagement part 36B side with respect to the center between the first engagement part 35A and the second engagement part 35B.

In the above described embodiment, the second projection 41 is able to shift in the direction substantially perpendicular to the bottom wall part 33A; however, the present invention is not limited to such a configuration.

In the above described embodiment, the length L22 in the extending direction of the second extending part 36B provided on the second engagement part 35B is longer than the length L21 in the extending direction of the second extending part 36B of the first engagement part 35A; however, the present invention is not limited to such a configuration. The length L22 and the length L21 may be set to have the same length, or the length L22 may be set to be shorter than the length L21.

In the above described embodiment, the geometrical moment of inertia of the second extending part 36B provided on the second engagement part 35B is larger than the geometrical moment of inertia of the second extending part 36B provided on the first engagement part 35A; however, the present invention is not limited to such a configuration. The two geometrical moments of inertia may be set to be equal to each other or the magnitude relation of the two geometrical moments of inertia may be reversed.

In the above described embodiment, the first engagement part 35A and the second engagement part 35B are made of the same material, and therefore the geometrical moments of inertia of the first and second engagement parts 35 are differentiated to each other. However, the present invention is not limited to such a configuration. Specifically, the first engagement part 35A and the second engagement part 35B may be made of different materials, so that the flexural rigidity of the second extending part 36B provided on the second engagement part 35B becomes larger than the flexural rigidity of the second extending part 36B provided on the first engagement part 35A.

In the above described embodiment, the electric wiring 30E is provided to extend in the direction substantially parallel with the extending direction of the second extending part 36B; however, the present invention is not limited to such a configuration. The electric wiring 30E may be provided to extend in another direction.

In the above described embodiment, the face center G1 of a plane figure dined by the plurality of first projections 39 as apexes lies within the zonal virtual area connecting the two engagement parts 35. However, the present invention is not limited to such a configuration. For example, the face center G1 may be located outside the above described zonal virtual area.

The sensor unit 30 according to the embodiment is an optical sensor which reads a correction mark formed on the belt 13. However, the present invention is not limited to such a configuration. The sensor unit 30 may be a sensor unit for use of another purpose, such as, detection of the remaining amount of developer.

In the above described embodiment, the engagement part 35 and the first projection 39 are integrally formed with the holder 30C. However, the present invention is not limited to such a configuration. The engagement part 35 and the first projection 39 may be separately provided.

In the above described embodiment, the pressing part 37C is formed to project on the window 33C side; however, the present invention is not limited to such a configuration. For example, the pressing part 37C may be formed to project on the opposite side of the window 33C or the pressing part 37C may be omitted.

What is claimed is:

1. An image forming apparatus, comprising:

an image formation unit configured to form an image on a sheet;

a sensor unit having a light-emitting device and a light-receiving device;

a frame to which the sensor unit is attached;

at least one projection provided on one of the sensor unit and the frame, the at least one projection being formed to have a contacting part which projects to contact the other of the sensor unit and the frame;

at least one engagement part provided on one of the sensor unit and the frame, the at least one engagement part being formed to engage with at least one catching part provided on the other of the sensor unit and the frame and to press the at least one projection in a direction of increasing a contact surface pressure of the contacting part by causing elastic deformation; and a projecting part provided on one of the sensor unit and the frame, the projecting part being formed to fit into a recessed part formed in the other of the sensor unit and the frame;

wherein:

the at least one engagement part comprises a first engagement part and a second engagement part;

each of the first engagement part and the second engagement part comprises a first extending part formed to extend in a direction parallel with a projecting direction of the at least one projection, and a second extending part formed to extend in a direction perpendicular to an extending direction of the first extending part from a tip of the first extending part in the extending direction of the first extending part, so that each of the first engagement part and the second engagement part is formed in shape of a letter L;

the second extending part of the first engagement part and the second extending part of the second engagement part extend in a same direction;

the at least one catching part comprises a first through hole through which the first extending part of the first engagement part penetrates and a second through hole thorough which the first extending part of the second engagement part penetrates;

the second extending parts of the first engagement part and the second engagement part engage with portions around the first through hole and the second through hole, respectively;

the first extending parts of the first engagement part and the second engagement part contact outer edges of the first through hole and the second through hole, respectively, so that movement of the first extending parts of the first engagement part and the second engagement part in a direction perpendicular to the extending direction of the first extending part and an extending direction of the second extending part is restricted; and the projecting part is formed to contact an inner edge of the recessed part so that movement of the projecting part in the extending direction of the second extending part is restricted.

2. The image forming apparatus according to claim 1, wherein the at least one projection is provided between the first and second engagement parts.

3. The image forming apparatus according to claim 1, wherein:

the second extending part of each of the first engagement part and the second engagement part extends in a direction pointing from the first engagement part to the second engagement part;

the projecting part is provided on a side closer to the first engagement part with respect to a center between the first engagement part and the second engagement part; and a length in the extending direction of the second extending part provided on the second engagement part is longer than a length in the extending direction of the second extending part provided on the first engagement part.

4. The image forming apparatus according to claim 3, wherein a geometrical moment of inertia of the second extending part provided on the second engagement part is larger than a geometrical moment of inertia of the second extending part provided on the first engagement part.

5. The image forming apparatus according to claim 1, wherein an electric wiring provided for the sensor unit extends in a direction substantially parallel with the extending direction of the second extending part of each of the first engagement part and the second engagement part.

6. The image forming apparatus according to claim 2, wherein:

the at least one projection comprises at least three projections;

a face center of a plane figure defined by the at least three projections as apexes lies within a zonal virtual area connecting the two engagement parts.

7. The image forming apparatus according to claim 1, further comprising a belt provided to extend between at least two rollers, wherein:

the at least one engagement part comprises a first extending part formed to extend in a direction parallel with a projecting direction of the at least one projection, and a second extending part formed to extend in a direction perpendicular to an extending direction of the first extending part from a tip of the first extending part in the extending direction of the first extending part, so that the at least one engagement part is formed in a shape of a letter L;

the at least one catching part is a through hole through which the first extending part penetrates;

the second extending part engages with a portion around the through hole;

the first extending part contacts an outer edge of the through hole so that movement of the first extending part in a direction perpendicular to the extending direction of the first extending part and an extending direction of the second extending part is restricted; and the extending direction of the second extending part is parallel with a center axis of each of the at least two rollers.

8. An image forming apparatus, comprising:

an image formation unit configured to form an image on a sheet;

a sensor unit having a light-emitting device and a light-receiving device;

a frame to which the sensor unit is attached;

at least one projection provided on one of the sensor unit and the frame, the at least one projection being formed to have a contacting part which projects to contact the other of the sensor unit and the frame;

at least one engagement part provided on one of the sensor unit and the frame, the at least one engagement part being formed to engage with at least one catching part provided on the other of the sensor unit and the frame and to press the at least one projection in a direction of increasing a contact surface pressure of the contacting part by causing elastic deformation; and a belt provided to extend between at least two rollers;

wherein:

the at least one engagement part comprises a first extending part formed to extend in a direction parallel with a projecting direction of the at least one projection, and a second extending part formed to extend in a direction perpendicular to an extending direction of the first extending part from a tip of the first extending part in the extending direction of the first extending part, so that the at least one engagement part is formed in a shape of a letter L;

the at least one catching part is a through hole through which the first extending part penetrates;

the second extending part engages with a portion around the through hole;

the first extending part contacts an outer edge of the through hole so that movement of the first extending part in a direction perpendicular to the extending direction of the first extending part and an extending direction of the second extending part is restricted; and the extending direction of the second extending part is parallel with a center axis of each of the at least two rollers.

* * * * *